US006698049B2

(12) United States Patent
McLoudrey

(10) Patent No.: US 6,698,049 B2
(45) Date of Patent: Mar. 2, 2004

(54) MULTI-FUNCTIONAL HAND TOOL

(76) Inventor: Thomas McLoudrey, 2632 Ball Way, Sacramento, CA (US) 95821

( * ) Notice: Subject to any disclaimer, the term of this patent is extended or adjusted under 35 U.S.C. 154(b) by 0 days.

(21) Appl. No.: 10/087,808

(22) Filed: Mar. 5, 2002

(65) Prior Publication Data

US 2003/0167573 A1 Sep. 11, 2003

(51) Int. Cl.[7] ..... B26B 11/00

(52) U.S. Cl. ..... 7/158; 7/118; 7/156; 7/168; 7/161; 7/177.3; 7/440; 30/158; 30/160

(58) Field of Search ..... 7/158, 118, 156, 7/168, 161, 177.3, 440, 488; 30/158, 160

(56) References Cited

U.S. PATENT DOCUMENTS 4,776,094 A * 10/1988 Glesser ..... 30/160
4,805,303 A * 2/1989 Gibbs ..... 30/161
5,920,935 A 7/1999 Beck
6,293,018 B1 * 9/2001 Rivera ..... 30/155
6,389,625 B1 * 5/2002 Rivera ..... 7/128
6,412,130 B1 * 7/2002 Kershaw et al. ..... 7/129
6,460,433 B1 * 10/2002 Ackeret et al. ..... 81/440
6,510,767 B1 * 1/2003 Rivera ..... 81/440

* cited by examiner

*Primary Examiner*—Lee D. Wilson
*Assistant Examiner*—Alvin J Grant
(74) *Attorney, Agent, or Firm*—Kelly J McCrystle

(57) ABSTRACT

A multi-functional tool configured to enable a user to manipulate articles of clothing, the multi-functional tool including a first handle, a second handle, a pivot pin, and a plurality of tools rotatably disposed about the pivot pin. Wherein each tool is configured to provide a specific function to the user of the multi-functional tool. Still further, in accordance with the present invention there is provided a multi-functional tool that includes a plurality of tools configured to manipulate buttons and zippers disposed on articles of clothing.

20 Claims, 6 Drawing Sheets

MULTI-FUNCTIONAL HAND TOOL

FIELD OF THE INVENTION

The present invention relates to a multi-functional hand tool, and more specifically compact hand tools which have a multiplicity of implements for use in a variety of applications.

BACKGROUND OF THE INVENTION

Hand tools are commonly used by craftsmen, mechanics, and homeowners during the assembly, construction and/or repair of items ranging from large commercial buildings and automobiles to children's toys. Based on the almost endless uses for hand tools there are literally thousands of different variations of tools designed for specific trades or applications. Unfortunately, it is both expensive, impractical and extremely burdensome for craftsmen or homeowners to either own every type of tool or carry a multitude of hand tools on a job site or personal travels due to their combined weight and burdensome nature.

To address the aforementioned problems associated with craftsmen and homeowners carrying a multitude of individual hand tools, "combination" hand tools have been designed which have numerous implements on one given tool, thus making the tool applicable for a variety of uses. The most common implements found on combination hand tools include pliers, knives, can openers, awls, bottle openers and other tools. Unfortunately, many of these tools are designed for specific mechanical functions and cannot be utilized for other purposes. Additionally, many of these hand tools are too large and heavy and are not designed for use by individuals who possess minimal grip strength.

Still further, many of these combination hand tools dispose to numerous implements in a folded arrangement such as a common folding pocket knife. Though this provides a compact size to the device it additionally makes it difficult to deploy the tools. In many of these devices the tools include a recessed portion where the user is to insert a fingernail to deploy the tool, thus requiring the use of two hands, one to grip the body of the tool and the second to deploy the implement. This presents a hurdle to users who do not posses the required grip strength to hold the tool in one hand and utilize a fingernail to open the desired tool. Therefore there is a need for a multi-functional tool wherein the individual tools are more easily deployable.

Additionally, many multi-functional tools available only include tools for performing mechanical functions, that is, they include tools such as screwdrivers, wrenches, can openers or similar tools for performing mechanical functions. While these tools may be useful for performing mechanical repairs or other jobs around the house, there is a need for a multi-functional tool that includes specialized tools for performing specialized functions. For example, there are many individuals who do not posses the required grip strength due to physical limitations such as arthritis, to manipulate items such as zippers and buttons, thus these individuals may require assistance to dress/undress. There have been attempts to produce individual tools that are configured to help a user manipulate buttons. These tools are usually comprise a wire loop disposed on the end of a long shaft. The wire loop is placed around a button and the user then manipulates the tool to draw the button through the button hole. Although this tool allows a user to button their clothing, there are many shortcomings of this device. The first shortcoming is that this type of tool cannot be utilized with large buttons such as those on men's or women's jeans because the wire loop disposed on the tool is not strong enough that a large force can be applied to it. Still further, the wire loop buttoning tool cannot be utilized to unbutton clothing, therefore assistance may still be required to unbutton the article of clothing. Lastly, due to the length of the tool the tool is not designed to be taken with the individual when they leave their residence, thus if the individual needs to button an article of clothing they must do so at home.

Therefore, there is a need for a multi-functional tool that is easily transportable and includes specialized tools for performing specific functions.

There is also a need for a multi-functional tool that includes a plurality of folding tools disposed within a body wherein the folding tools may be easily deployed without requiring a high degree of strength.

SUMMARY OF THE INVENTION

In accordance with the present invention there is provided a multi-functional tool configured to enable a user to manipulate articles of clothing, the multi-functional tool including a first handle, a second handle, a pivot pin, wherein the pivot pin is configured to be fixedly received at one end by the first handle and fixedly received at the other end by the second handle, thereby forming a space between the first and second handle, a zipper pick, the zipper pick is configured to rotate between a retracted position to an open position, the tool further including an aperture formed therein, the aperture configured to receive a users finger to facilitate rotation from the retracted to the opened position, and at least one tool rotatably disposed about the pivot pin, wherein the tool is configured to rotate between a retracted position to an open position, the tool further including an aperture formed therein, the aperture configured to receive a users finger to facilitate rotation from the retracted to the opened position.

In accordance with another aspect of the present invention there is provided a multi-functional tool including a plurality of tools, the multi-functional tool including a first handle, a second handle, at least one pivot pin, the pivot pin interconnected to the first and second handles, a pair of scissors rotatably disposed about the pivot pin, wherein the tool is configured to rotate between a retracted position to an open position, the tool further including an aperture formed therein, the aperture configured to receive a user's finger to facilitate rotation from the retracted to the opened position, a pair of forceps rotatably disposed about the pivot pin, wherein the tool is configured to rotate between a retracted position to an open position, the tool further including an aperture formed therein the aperture configured to receive a user's finger to facilitate rotation from the retracted to the opened position, and at least one additional tool rotatably disposed about the pivot pin, wherein the tool is configured to rotate between a retracted position to an open position, the tool further including an aperture formed therein, the aperture configured to receive a user's finger to facilitate rotation from the retracted to the opened position.

In accordance with yet another aspect of the present invention there is provided a multi-functional tool, the multi-functional tool including a first handle, a second handle, at least one pivot pin, wherein the pivot pin is configured to be fixedly received at one end by the first handle and fixedly received at the other end by the second handle, thereby forming a space between the first and second handle. The multi-functional tool further including a plurality of tool the plurality of tools being: a zipper pick, the zipper pick is configured to rotate between a retracted position to an open position, the tool further including an aperture formed therein, the aperture configured to receive a user's finger to facilitate rotation from the retracted position; a pair of scissors disposed about the pivot pin, wherein the tool is configured to rotate between a retracted position to an open position, the tool further including an aperture formed therein, the aperture configured to receive a user's finger to facilitate rotation from the retracted to the opened position; a pair of forceps disposed about the pivot pin, wherein the tool is configured to rotate between a retracted position to an open position, the tool further including an aperture formed therein, the aperture configured to receive a user's finger to facilitate rotation from the retracted to the opened position; a wire button loop disposed about the pivot pin, wherein the tool is configured to rotate between a retracted position to an open position, the tool further including an aperture formed therein, the aperture configured to receive a user's finger to facilitate rotation from the retracted to the opened position; and a small button hook and a large button hook, each disposed about the pivot pin, wherein the tool is configured to rotate between a retracted position to an open position, the tool further including an aperture formed therein, the aperture configured to receive a user's finger to facilitate rotation from the retracted to the opened position.

BRIEF DESCRIPTION OF THE DRAWINGS

There will now be described preferred embodiments of the present invention with reference to the drawings, by way of illustration, in which like numerals denote like elements and in which.

DETAILED DESCRIPTION OF PREFERRED EMBODIMENTS

Figure 1:
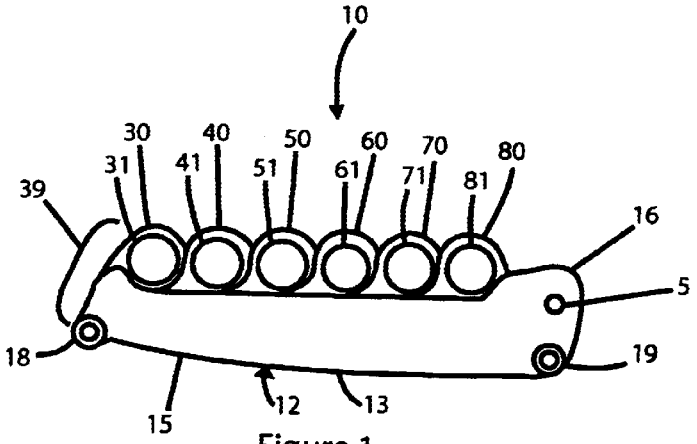
FIG. 1 is a side elevation view of the multi-functional tool in accordance with the present invention.

Referring now to the drawings, FIG. 1 illustrates a side elevation view of an exemplary embodiment of the multi-function tool in accordance with the present invention. In general, the multi-function tool 10 is comprised of a first handle 12 and a second handle 22 which are interconnected by lanyard rings 18 and 19 disposed at each end of the handles. The first handle 12 includes a first end 14 and a second end 16. The second end 16 generally includes the pin 5, wherein a plurality of individual tools 30–80 are pivotally disposed about the pin 5. Furthermore, as shown in FIG. 1, the first handle 12 and the second handle 22 may include a recessed area configured to receive a decorative material 13. The decorative material may be affixed to the sides using means 15 as shown. For example, the handles 12, 22 may be formed of a metal such as stainless steel, steel, titanium, aluminum or other suitable material, wherein the recessed area is integrally formed therein and configured to receive a second material such as decorative wood, plastic, bone, or other similar non-structural or structural materials which lend structural and artistic effect to the multi-function tool 10.

The second handle 22 (not shown) is generally constructed in the same manner as that of the first handle and may or may not include the recessed area. The first and second handles should be configured such that when they are spaced apart from one another with the pins 18 and 19 they form a device having a single side profile. An additional spacing material (not shown) may be disposed between the first side and second side and opposite the plurality of individual tools to provide a smooth handle surface in use.

As shown in FIG. 1, the plurality of individual tools 30–80 are configured to be received between the first and second handles. Each of the plurality of individual tools 30–80 is pivotally rotatable about the pin 5. Additionally, as shown in FIG. 1, each of the individual tools 30–80 includes an aperture 31,41,51,61,71, and 81 formed within each of the tools, wherein the apertures are configured to receive a user's finger thereby allowing the user to move each individual tool from a retracted position as that shown in FIG. 1 to an extended position or a partially extended position as that shown in FIG. 2. It is further contemplated that a dowel, stick, rod or other device may be disposed through the aperture to increase the leverage on each of the tools.

Figure 2:
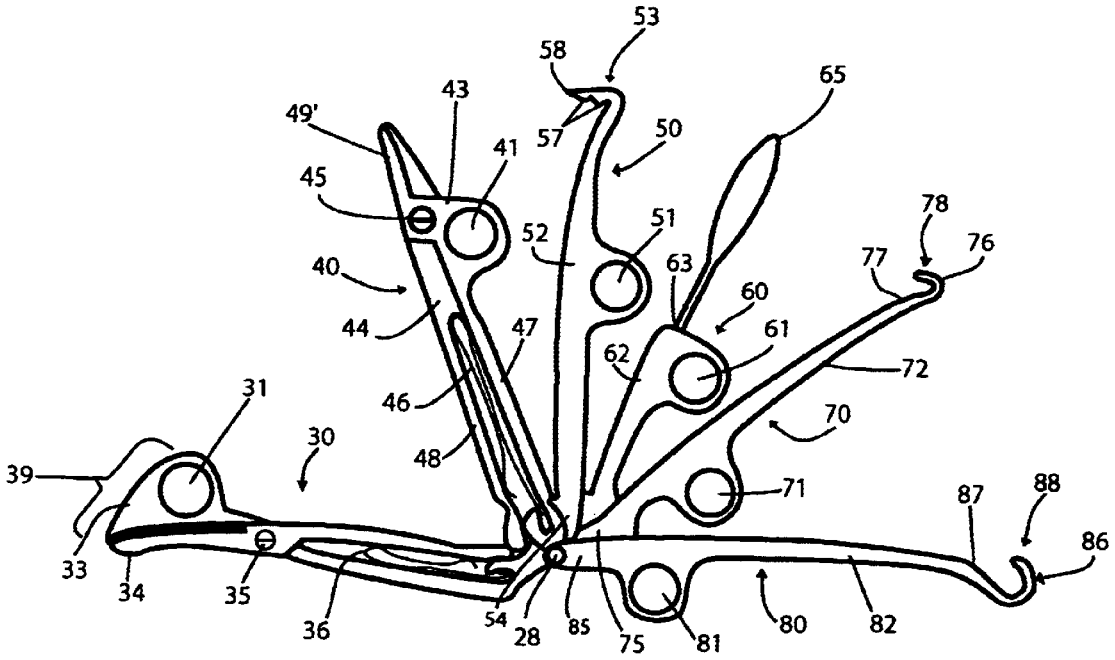
FIG. 2 is a side elevation view of the multi-function tool in accordance with the present invention wherein the multiple tools are illustrated in a deployed or semi-deployed state.
Figure 3:
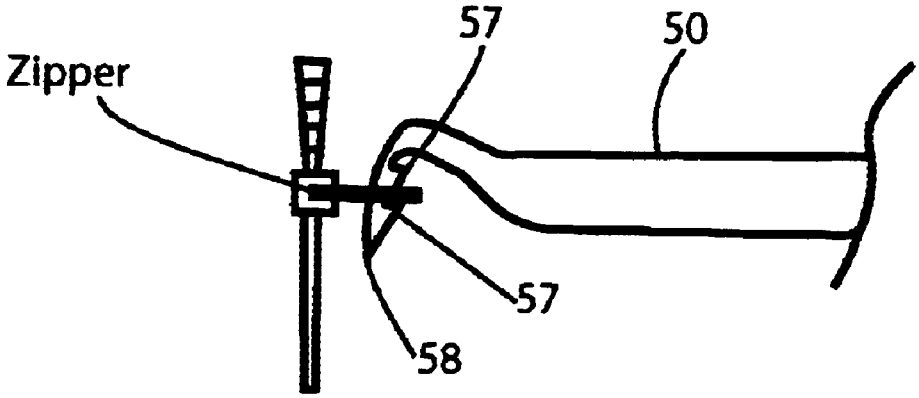
FIG. 3 is an illustration of the zipper pick of the multi-functional tool in use.

Referring now to FIG. 2, there is shown each of the individual tools 30–80 in a deployed or semi-deployed state. As shown in FIG. 2 each of the individual tools are rotatably disposed about a single pivot point 28, the single pivot point corresponding to the pin 5. Each of the individual tools will be described in detail below with reference to FIG. 2.

Referring now to the first tool 30, there is shown a pair of scissors in accordance with the present invention. As shown, the scissors 30 include a first blade 33 and a second blade 34, and a spring 36. The first and second blade portions are pivotally connected through a pivot point 35, wherein the spring 36 is disposed between the first and second blades and configured to bias the first and second blades. The first blade 33 is further configured to be pivotally disposed about the pin 5 as described above. The first blade and the second blade further include handle portions 37 and 38, wherein the handle portions are located a distance from the pivot point 35 and are configured to receive a users hand. Additionally, the first end 39 of the first blade includes a radiused raised portion wherein the aperture 31 is formed therein. As shown in FIG. 2, the first ends of the each of the blades may be formed to include a blunted tip portion, thereby providing a safety feature. Though this should not be considered limiting in any manner. It is contemplated that the tip portions of the blades may be configured in any manner.

Referring now to the second tool 40, there is shown a pair of pliers/forceps in accordance with the present invention.

As shown, the forceps 40 include a first arm 43 and a second arm 44, and a spring 46. The first and second arm portions are pivotally connected through a pivot point 45, wherein the spring 46 is disposed between the first and second arms and configured to bias the first and second arms. The first arm 43 is further configured to be pivotally disposed about the pin 5 as described above. The first arm and the second arm further include handle port ions 47 and 48, wherein the handle portions are located a distance from the pivot point 35 and are configured to receive a users hand. Additionally, the first end 49 of the first arm includes a radiused raised portion wherein the aperture 41 is formed therein. The distal ends of the first and second arms further include jaw portions 49', wherein the jaw portions 49' are configured for gripping. For example, the jaw portions 49' may include a plurality of ridges or a raised surface, wherein the ridges or raised surface is configured for gripping. As shown in FIG. 1, the raised radiused portion including the aperture 41 is disposed adjacent to the jaw portion 49', wherein as show n in FIG. 1, the aperture 41 is set off from the aperture 31 of the scissors 30.

Figure 4:
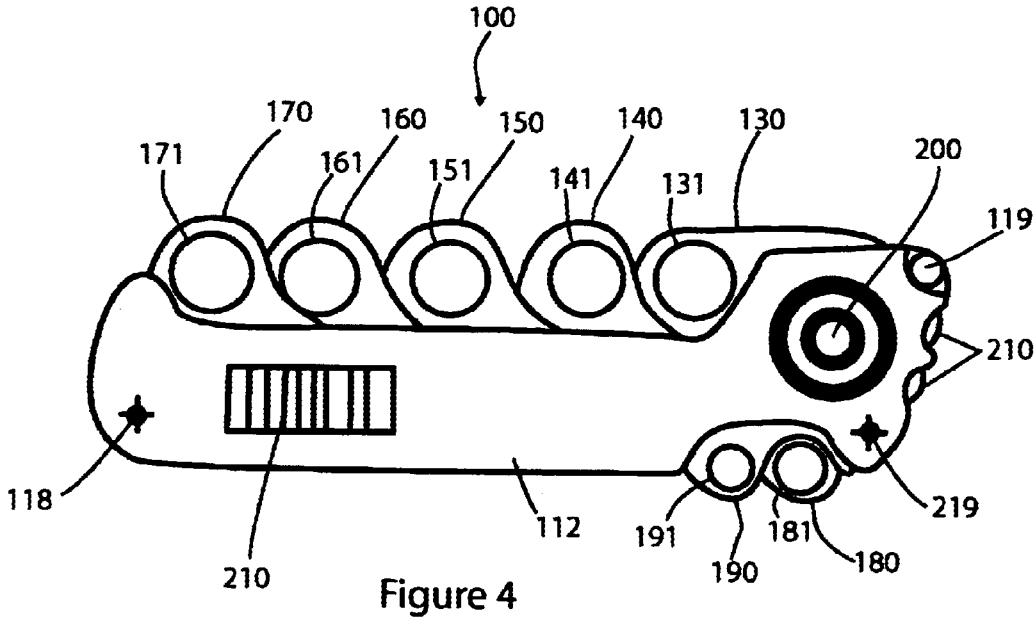
FIG. 4 is a side elevation view of an alternative embodiment of the multi-function tool in accordance with the present invention.

Referring now to the third tool there is shown a zipper pick 50 in accordance with the present invention. As shown, the zipper pick 50 comprises an elongated member 52 having a first end 53 and a second end 54. The second end 54 is configured to be rotatably disposed about the pin 5 as described above. A raised radiused portion is disposed adjacent to the first end 53, wherein the raised portion further includes an aperture 51, the aperture configured to receive a users finger. As shown in FIG. 1, the raised portion of the zipper pick 50 is disposed adjacent to the first end 53 in a manner such that the aperture 51 is set off from the apertures 31–81 of the other tools, thereby allowing unhindered access to the zipper pick. As shown in FIG. 2, the first end 53 of the zipper pick further includes a plurality of teeth 57 formed on the first end 53. In use, the user would deploy the zipper pick from a retracted position such as that shown in FIG. 1 to a deployed position (not shown) by applying force to the aperture 51, thereby rotating the zipper pick about the pin 5. The distal end 58 of the first end would then be placed into an aperture formed in a zipper handle as shown in FIG. 4. The user may then apply force to the zipper by applying a force to the multi-function tool 10. For example, if the user it trying to zip a pair of pants, they would place the distal end of the zipper pick through the aperture of the zipper handle where the teeth 57 would engage the zipper handle or tab, then pull up on the multi-function tool, though which the zipper mechanism would be moved from an unzipped position to a zipped position. The user would then remove the distal end of the zipper pick from the aperture of the zipper handle. Throughout the process described above, the use of the zipper pick does not require a secondary step to affix the zipper pick to the zipper handle or any further step than placing the distal end of the zipper pick through the aperture of the zipper handle. By temporarily attaching the zipper pick to the zipper handle, this provides the user with longer lever to which force may be applied to the zipper, thus requiring less grip strength by the user and increasing the leverage on the zipper handle or tab. Additionally, the handle portion of the multi-functional tool 10 is easier to grip than the zipper handle.

Referring now to the fourth tool, there is shown a wire button hook 60 in accordance with the present invention. As shown in FIG. 2, there wire button hook 60 includes an elongated member 62 having a first end 63 and a second end 64 and a wire loop 65 extending from the first end 63. The second end of the elongated member is configured to be rotatably received by pin 5 as described above. The wire button hook 60 further includes a raised radiused portion disposed adjacent to the first end 63. The wire loop 65 is configured to extend from the first end 63 as shown. It is contemplated that the wire loop may be fixedly attached to the elongated member 62. In a preferred embodiment the wire loop 65 is removably attached to the elongated member, and may be affixed to the elongated member through means such as a set screw, adhesives, detachable connector(s) or similar mechanical means that maybe configured to selectively retain and release the wire loop 65. The wire loop 65 may be constructed of materials such as steel, stainless steel, composite materials, plastics, Nitinol, or other similar materials.

In use, the wire loop is passed through a button hole in a garment and then about a button on the garment. The loop is then drawn back through the button hole, thus drawing the button therethrough in addition to drawing the wire loop therethrough.

Referring now to the fifth tool, there is shown a small button hook 70 in accordance with the present invention. The small button hook 70 comprises an elongated member 72 having a first end 73 and a second end 74, wherein the second end 74 is configured to be pivotally disposed about the pin 5 as described above. The elongated member 72 further includes a raised radiused portion including an aperture 71 disposed therethrough, the raised radiused portion being disposed adjacent to the second end 75. As shown in FIG. 2, the first end 73 of the small button hook 70 includes a curved portion 76 and a reduced thickness portion 77, wherein the curved portion forms a hook 78. The hook 78 being configured to receive a button in use.

Referring now to the sixth tool, there is shown a large button hook 80 in accordance with the present invention. The large button hook 80 comprises an elongated member 82 having a first end 83 and a second end 84, wherein the second end 84 is configured to be pivotally disposed about the pin 5 as described above. The elongated member 82 further includes a raised radiused portion including an aperture 81 disposed therethrough, the raised radiused portion being disposed adjacent to the second end 85. As shown in FIG. 2, the first end 83 of the large button hook 80 includes a curved portion 86 and a reduced thickness portion 87, wherein the curved portion forms a hook 88. The hook 88 being configured to receive a button in use.

As described above, both the small button hook 70 and the large button hook 80 are configured to enable a user to button clothing, though each device is designed for a specific purpose. The small button hook 70 is sized to allow a user to manipulate smaller buttons such as those found on shirts. The large button hook 80 is configured to be used on larger buttons such as those found on pants, jackets, skirts and similar items. In use, the respective button hook is passed through the button hole, then the distal end of the button hook is disposed about the button, the button and button hook are then drawn back through the button hole, thereby drawing the button though the button hole. It shall be understood that the wire loop, small button hook, and large button hook function in a similar manner, though in use, the wire loop is intended to be utilized on clothing items that are knitted or constructed of fragile fabric, because the smooth surface of the wire loop will not damage the garment. Thus, it shall be understood that the small button hook and the large button hook should not be utilized on knitted items or items constructed of fragile fabric because the distal end may snag the garment and damage the article.

In use, when the user wishes to unbutton their clothing article, they may employ the use of the forceps. The user would deploy the forceps from their folded position as shown in FIG. 1 to a deployed position. In the deployed position, the first and second arm would be biased apart by the spring thereby opening the jaw portion. The user would then place the button within the jaw portion and apply a force to the first and second arms to close the jaws, the user can then utilize the tool to manipulate the button back through the button hole, thereby unbuttoning the garment.

Referring now to FIG. 4, there is shown a side elevation view of an alternative embodiment of the multi-functional tool 100 in accordance with the present invention. As shown in FIG. 4, the multi-functional tool 100 is comprised of a first handle 112 and a second handle 122 which are interconnected by pins 118, 119, and 219 disposed at end of the handles. The first handle 112 includes a first end 114 and a second end 116. The second end 116 generally includes the pin 119, wherein a plurality of individual tools 130–170 are pivotally disposed about the pins 119 and 118, and tools 180 and 190 are pivotally disposed about pin 219. The handles 112, 122 may be formed of a metal such as stainless steel, steel, titanium, aluminum or other suitable material. Additionally, the multi-functional tool 100 may further include an illumination device disposed within the handle(s) as shown in FIG. 4, wherein the illumination device includes at least one light emitting device 210 and a switching device 200 and a power source (not shown). It is contemplated that the light emitting device may comprise at least one light emitting diode, a fluorescent bulb, or a laser source, or other light emitting sources. The switching device may be configured to activate the light emitting device through a sliding action or a pressing action.

Still further, the multi-function tool 100 further includes a locking mechanism and release latch 210, wherein the locking mechanism is configured to retain the various tools in both a retracted position and an extended position. The locking mechanism is similar to those found on conventional pocket knives, wherein each of the tools are configured to receive a locking tab in both the retracted position and the opened position. The release latch 210 is configured to release the locking tab, thereby allowing a user to move each of the tools relative to the handles. It shall be understood by one skilled in the art that many different locking mechanism may be utilized with the multi-function tool 100 in accordance with the present invention.

Figure 5:
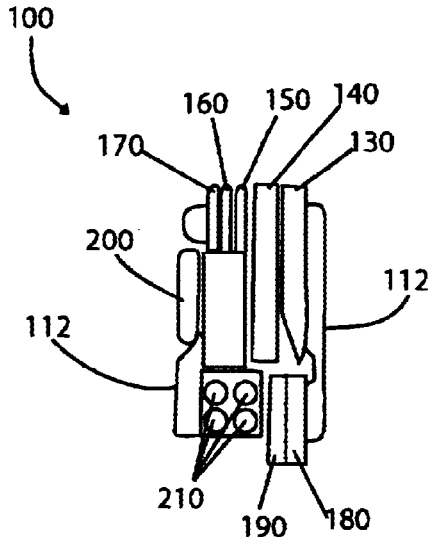
FIG. 5 is an end view of the alternative embodiment of the multi-function tool.

Referring now to FIG. 5, there is shown an end view of the multi-functional tool 100 in accordance with the present invention. As shown in FIG. 5, each of the individual tools 130, 140, 150, 160, 170, 180, and 190 are configured to be foldably received between the first handle and the second handle, wherein each respective tool is pivotally disposed about their respective pivot pin.

Figure 6:
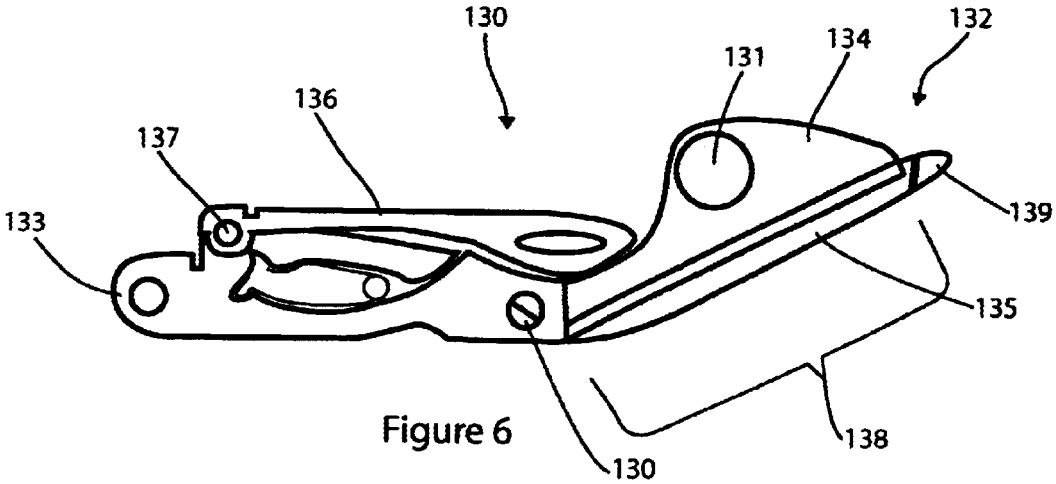
FIG. 6 is a side view of a pair of scissors disposed within the multi-functional tool.

Referring now to FIG. 6, there is shown a pair of scissors 130 in accordance with the present invention. As shown, the scissors include a first end 132 and a second end 133, wherein the second end 133 is configured to be rotatably disposed about pin 118. The scissors 130 include a first blade 134, a second blade 135, and a lever 136. The first and second blades 134 and 135 are pivotally connected about a pivot point 137. The lever 136 is pivotally connected to the first and second blades, wherein the lever may be actuated to actuate the cutting portion 138 of the first and second cutting blades. By providing a lever 136 to actuate the cutting portion of the cutting blades allows the user to apply a greater amount of force to the cutting portion of the cutting blades. Thus, the scissors 130 differ from those described above, in that the scissors 130 are configured to cut heavier materials for example, the scissors 130 may be utilized to cut through a persons clothing in an emergency situation. Additionally, by providing a lever to actuate the scissors 130 this enables a user to get a greater purchase and therefore apply a greater force. Still further, by providing a lever, this enables a user to wear gloves while using the scissors, for example, an emergency medical technician may utilize the scissors 130 to remove a patient's clothing in an emergency situation. Additionally, the distal tip 139 of the second blade 135 has been dulled, such that in use, the distal tip maybe placed against a patient's skin to advance the cutting portions without cutting the patient. The first blade 134 further includes a raised radiused portion including an aperture 141 disposed therein. The aperture is configured to receive a user's finger, thereby enabling the user to deploy the scissors 130 from a retracted position to an extended position.

Figure 7:
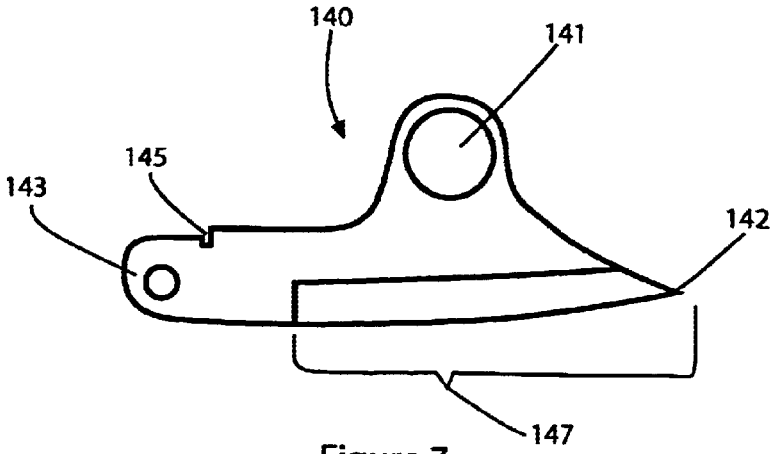
FIG. 7 is a side view of a utility knife disposed within the multi-functional tool.

Referring now to FIG. 7, there is shown a utility knife 140 in accordance with the present invention. As shown, the utility knife 140 includes a first end 142 and a second end 143, wherein the second end 143 is configured to be rotatably disposed about pin 118 or 119. The second end 143 further includes a notch 145, wherein the notch 145 is configured to receive a locking tab of the locking device. The utility knife 140 further includes a raised radiused portion including an aperture 141, wherein the aperture 141 is configured to receive a users finger, thereby enabling a user to deploy the utility knife from a retracted position to an extended position by applying a force to the aperture 141. The utility knife 140 further includes a blade 147. The blade 147 extends from the first end to a portion adjacent to the second end.

Figure 8:
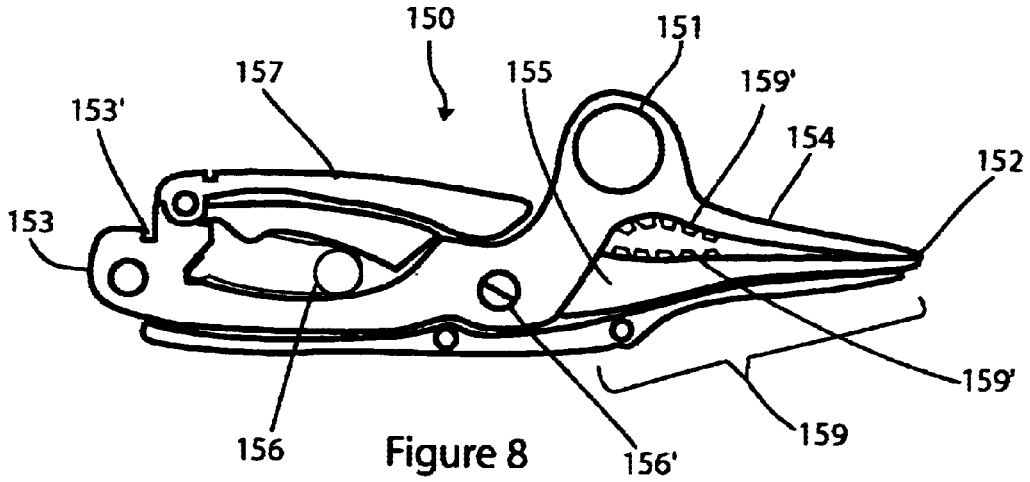
FIG. 8 is a side view of a pair of forceps disposed within the multi-functional tool.

Referring now to FIG. 8, there is shown a pair of forceps 150 in accordance with the present invention. As shown, the forceps include a first end 152 and a second end 153, wherein the second end 153 is configured to be rotataby disposed about pin 118 or 119. The second end further includes a notch 153', wherein the notch is configured to receive a locking tab of the locking device in accordance with the present invention. The forceps include a first arm 154 and a second arm 155, a spring 156 and a lever 157. The lever 157 is pivotally connected to the first and second arms, wherein the spring 156 biases the lever 157 and the first and second arms, wherein the first and second arm are pivotally connected through a pivot point 156'. Additionally, the first arm includes a radiused raised portion wherein the aperture 151 is formed therein. The distal ends of the first and second arms further include jaw portions 159, wherein the jaw portions 159 are configured for gripping.

For example, the jaw portions 159 may include a plurality of ridges 159' or a raised surface 159', wherein the ridges or raised surface is configured for gripping.

In use, when the forceps are moved from a retracted position to a deployed position, the spring 156 provides a biasing force, causing the first and second arm to expand and open the jaw portions and lift the lever from a retracted position. A user may then apply a force to the lever, thus causing the jaw portions to close. By utilizing a lever arrangement, this allows a user to apply a greater amount of gripping force to the jaw portions. In addition to being able to apply a greater amount of force to the jaw portions, the lever configuration allows a user wearing gloves to operate the forceps without having to remove their gloves. It is further contemplated that the jaw portions of the forceps may be configured to include other devices such as wire cutters, recessed portions configured to receive a bolt or nut or similar modifications.

Figure 9:
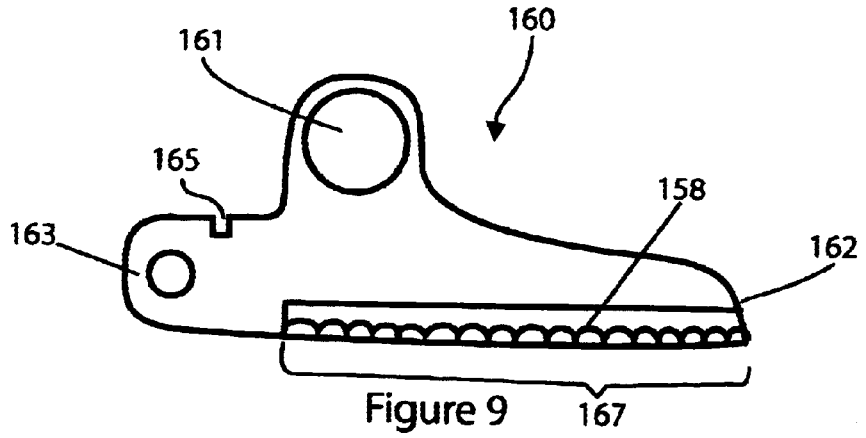
FIG. 9 is a side view of a serrated cutter disposed within the multi-functional tool.

Referring now to FIG. 9, there is shown a heavy duty cutter 160 in accordance with the present invention. As shown, the heavy duty cutter 160 includes a first end 162 and a second end 163, wherein the second end 163 is configured to be rotatably disposed about pin 118 or 119. The second end 163 further includes a notch 165, wherein the notch 165 is configured to receive a locking tab of the locking device. The heavy duty cutter 160 further includes a raised radiused portion including an aperture 161, wherein the aperture 161 is configured to receive a users finger, thereby enabling a user to deploy the heavy duty cutter 160 from a retracted position to an extended position by applying a force to the aperture 161. The heavy duty cutter 160 further includes a blade 167. The blade 167 extends from the first end to a portion adjacent to the second end. As shown in FIG. 8, the blade 157 includes a plurality of grooves 158 formed therein, thereby forming a serrated blade. The serrated blade of the heavy duty cutter 160 is configured to cut through materials quicker than the blade of the utility knife 140.

Figure 10:
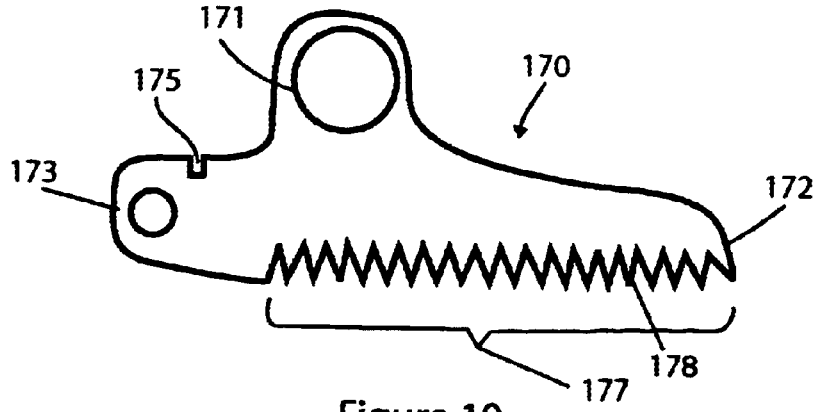
FIG. 10 is a side view of a saw disposed within the multi-functional tool.

Referring now to FIG. 10, there is shown a saw 170 in accordance with the present invention. As shown, the wood saw 170 includes a first end 172 and a second end 173, wherein the second end 173 is configured to be rotatably disposed about pin 118 or 119. The second end 173 further includes a notch 175, wherein the notch 175 is configured to receive a locking tab of the locking device. The saw 170 further includes a raised radiused portion including an aperture 171, wherein the aperture 171 is configured to receive a users finger, thereby enabling a user to deploy the saw 170 from a retracted position to an extended position by applying a force to the aperture 171. The wood saw 170 includes a serrated blade 177, wherein the serrated blade includes a plurality of teeth 178 arranged in a pattern that is efficient for cutting through materials such as wood and light metal. It shall be understood that the teeth 178 may be disposed in any pattern and the pattern as shown should not be considered limiting. Furthermore, it is contemplated that the teeth 178 may be replaced by other cutting means. For example, the cutting means may comprise a composite material bonded to the edge of the saw.

Figure 11:
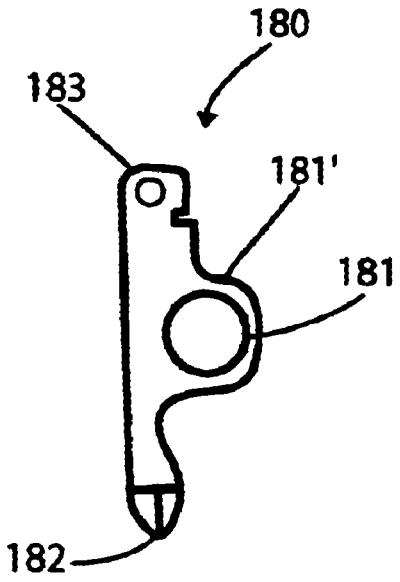
FIG. 11 is a side view of a screwdriver disposed within the multi-functional tool.

Referring now to FIG. 11 there is shown a screwdriver 180 in accordance with the present invention. As shown, the screwdriver 180 includes a first end 182 and a second end 183, wherein the second end is configured to be rotatably disposed about pin 219. The screwdriver 180 further includes a raised radiused portion 181', wherein the raised radiused portion includes an aperture 181 disposed therethrough. The aperture 181 is configured to accept a users finger therein, thereby allowing a user to easily dispose the screwdriver from a closed position to an opened position.

Figure 12:
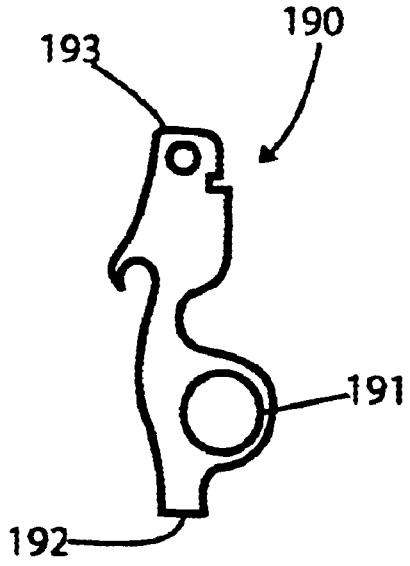
FIG. 12 is a side view of a combined screwdriver and bottle opener in accordance with the present invention.

Referring now to FIG. 12, there is shown a screwdriver/bottle opener 190 in accordance with the present invention. As shown, the screwdriver/bottle opener 190 includes a first end 192 and a second end 193, wherein the second end is configured to be rotatably disposed about pin 219. The screwdriver/bottle opener 190 further includes a raised radiused portion 191', wherein the raised radiused portion includes an aperture 191 disposed therethrough. The aperture 191 is configured to accept a users finger therein, thereby allowing a user to easily dispose the screwdriver from a closed position to an opened position.

As illustrated in FIG. 4, each of the apertures 131, 141, 151, 161, and 171 are configured to be offset from one another as shown. Thus when each of the respective tools are disposed within a closed position each respective aperture protrudes unobstructed from the body of the handle.

It shall be understood that each of the embodiments of the multi-function tools as shown in accordance with the present invention should not be considered limiting in any manner and that any combination of tools may be disposed within each of the multi-function tools. For example, it may be desirable to produce a multi-functional tool that is configured for specific purposes. For example, the multi-functional tool 10 is specifically configured to provide tools that enable a person to dress or undress themselves, the multi-function tool 100 is configured for a user such as an emergency medical technician or users with similar needs. It is contemplated that additional tools may be disposed within the handles of either multi-function tools. For example, it may be desirable to include any of the following tools, an adjustable wrench, box end wrenches, open end wrenches, Allen/torx wrenches, chain tool for bicycles.

We claim:

1. A multi-functional tool configured to enable a user to manipulate articles of clothing, the multi-functional tool comprising:

a first handle;

a second handle;

a pivot pin, wherein the pivot pin is configured to be fixedly received at one end by the first handle and fixedly received at the other end by the second handle, thereby forming a space between the first and second handle;

a zipper pick pivotally disposed about said pivot pin and carried within said space between said first and second handles, said zipper pick operable between a retracted position to an open position;

said zipper pick having a body with a predetermined shape including distal and proximal ends, wherein an enlarged portion having an aperture formed therein is disposed between said distal and proximal ends and projects from one edge of said body; and said zipper pick further includes a projection formed at said proximal end, wherein said projection is disposed at an angle to said body and includes at least one tooth disposed thereon.

2. The multi-functional tool according to claim 1, further including second tool disposed about said pivot pin, wherein said second tool is a pair of scissors, wherein the tool is configured to rotate between a retracted position to an open position, the tool further including an enlarged portion having an aperture formed therein, the aperture configured to receive a user's finger to facilitate rotation from the retracted to the opened position.

3. The multi-functional tool according to claim 2, further including a third tool, wherein the third tool is a pair of forceps, the forceps being configured to rotate between a retracted position to an open position, the tool further including an enlarged portion having an aperture formed therein, the aperture configured to receive a user's finger to facilitate rotation from the retracted to the opened position.

4. The multi-functional tool according to claim 3, further including a fourth tool, wherein the fourth tool is a wire button loop, is the button loop being configured to rotate between a retracted position to an open position, the tool further including an enlarged portion having an aperture formed therein, the aperture configured to receive a user's finger to facilitate rotation from the retracted to the opened position.

5. The multi-functional tool according to claim 4, further including a fifth tool, wherein the fifth tool is a small button hook, is the small button hook being configured to rotate between a retracted position to an open position, the tool further including an enlarged portion having an aperture formed therein, the aperture configured to receive a user's finger to facilitate rotation from the retracted to the opened position.

6. The multi-functional tool according to claim 5, further including a sixth tool, wherein the a-sixth tool is a large button hook, is the large button hook being configured to rotate between a retracted position to an open position, the tool further including an enlarged portion having an aperture formed therein, the aperture configured to receive a user's finger to facilitate rotation from the retracted to the opened position.

7. The multi-functional tool according to claim 1, wherein the multi-functional tool further includes an illuminating device.

8. The multi-functional tool according to claim 1, wherein the aperture is further configured to receive a dowel or stick therethrough, wherein the dowel or stick is configured to provide leverage.

9. A multi-functional tool including a plurality of tools, the multi-functional tool comprising:

a first handle;

a second handle;

at least one pivot pin, the pivot pin interconnected to the first and second handles;

a pair or scissors rotatably disposed about the pivot pin, wherein the tool is configured to rotate between a retracted position to an open position, the tool further including an aperture formed therein, the aperture configured to receive a user's finger to facilitate rotation from the retracted to the opened position;

a pair of forceps rotatably disposed about the pivot pin, wherein the tool is configured to rotate between a retracted position to an open position, the tool further including an aperture formed therein, the aperture configured to receive a users finger to facilitate rotation from the retracted to the opened position;

a zipper pick pivotally disposed about said pivot pin and carried within said space between said first and second handles, said zipper pick operable between a retracted position to an open position;

said zipper pick having a body with a predetermined shape including distal and proximal ends, wherein an enlarged portion having an aperture formed therein is disposed between said distal and proximal ends and projects from one edge of said body, said zipper pick further includes a projection formed at said proximal end, wherein said projection is disposed at an angle to said body and includes at least one tooth disposed thereon; and at least one additional tool rotatably disposed about the pivot pin, wherein the tool is configured to rotate between a retracted position to an open position, the tool further including an aperture formed therein, the aperture configured to receive a user's finger to facilitate rotation from the retracted to the opened position.

10. The multi-functional tool according to claim 9, wherein the additional tool is a utility knife.

11. The multi-functional tool according to claim 9, wherein the additional tool is a saw.

12. The multi-functional tool according to claim 9, wherein the additional tool is a screwdriver.

13. The multi-functional tool according to claim 12, wherein the screwdriver further includes a bottle opener.

14. The multi-functional tool according to claim 12, wherein the multi-functional tool further includes a second screwdriver.

15. The multi-functional tool according to claim 9, wherein the multi-functional tool further includes a illumination device.

16. The multi-functional tool according to claim 15, wherein the illumination device includes a power source, a switch, and at least one light emitting device.

17. The multi-functional tool according to claim 16, wherein the light emitting device is a light emitting diode.

18. The multi-functional tool according to claim 9, wherein the multi-functional tool further includes a locking mechanism, the locking mechanism configured to retain each tool in a retracted position and in an open position.

19. The multi-functional tool according to claim 5, wherein the wire button loop includes an elongated member and a wire loop, the wire loop detachably attached to the elongated member.

20. A multi-functional tool, the multi-functional tool comprising:

a first handle;

a second handle;

at least one pivot pin, wherein the pivot pin is configured to be fixedly received at one end by the first handle and fixedly received at the other end by the second handle, thereby forming a space between the first and second handle;

a zipper pick pivotally disposed about said pivot pin and carried within said space between said first and second handles, said zipper pick operable between a retracted position to an open position;

said zipper pick having a body with a predetermined shape including distal and proximal ends, wherein an enlarged portion having an aperture formed therein is disposed between said distal and proximal ends and projects from one edge of said body, said zipper pick further includes a projection formed at said proximal end, wherein said projection is disposed at an angle to said body and includes at least one tooth disposed thereon;

a pair of scissors disposed about the pivot pin, wherein the tool is configured to rotate between a retracted position to an open position, the tool further including an aperture formed therein, the aperture configured to receive a user's finger to facilitate rotation from the retracted to the opened position;

a pair of forceps disposed about the pivot pin, wherein the tool is configured to rotate between a retracted position to an open position, the tool further including an aperture formed therein, the aperture configured to receive a user's finger to facilitate rotation from the retracted to the opened position;

a wire button loop disposed about the pivot pin, wherein the tool is configured to rotate between a retracted position to an open position, the tool further including an aperture formed therein, the aperture configured to receive a user's finger to facilitate rotation from the retracted to the opened position; and a small button hook and a large button hook, each disposed about the pivot pin, wherein the tool is configured to rotate between a retracted position to an open position, the tool further including an aperture formed therein, the aperture configured to receive a user's finger to facilitate rotation from the retracted to the opened position.

* * * * *